US012239876B2

(12) United States Patent
Smallwood et al.

(10) Patent No.: US 12,239,876 B2
(45) Date of Patent: Mar. 4, 2025

(54) FOLDING MAT FOR RELIEVING SCIATIC AND COCCYX PRESSURE WHEN EXERCISING AND MEDITATING

(71) Applicants: James Smallwood, Boonville, MO (US); Mitsuko Yokoyama, Ibaraki (JP)

(72) Inventors: James Smallwood, Boonville, MO (US); Mitsuko Yokoyama, Ibaraki (JP)

( * ) Notice: Subject to any disclaimer, the term of this patent is extended or adjusted under 35 U.S.C. 154(b) by 0 days.

(21) Appl. No.: 17/745,801

(22) Filed: May 16, 2022

(65) Prior Publication Data

US 2022/0362622 A1 Nov. 17, 2022

Related U.S. Application Data

(60) Provisional application No. 63/189,202, filed on May 16, 2021.

(51) Int. Cl.
*A63B 21/00* (2006.01)

(52) U.S. Cl.
CPC ..... *A63B 21/4037* (2015.10); *A63B 2210/50* (2013.01); *A63B 2225/093* (2013.01)

(58) Field of Classification Search
CPC ..... A63B 21/4037; A63B 2210/52; A63B 2209/08; A63B 2210/50; A63B 2225/093
See application file for complete search history.

(56) References Cited

U.S. PATENT DOCUMENTS 3,744,483 A * 7/1973 Picolin ..... A61H 7/001 4/581
4,330,892 A * 5/1982 Fukushima ..... A47G 9/1036 5/636
4,370,767 A * 2/1983 Fraser ..... A47C 4/52 5/419
4,685,163 A * 8/1987 Quillen ..... A47C 27/081 5/613
5,096,188 A * 3/1992 Shen ..... A61H 7/001 601/134
5,099,530 A * 3/1992 Scott ..... A47G 9/02 5/500
5,195,197 A * 3/1993 Gutierrez ..... A47C 27/002 5/500
5,950,260 A * 9/1999 Dees ..... B25H 5/00 5/419
6,430,766 B1 * 8/2002 Henley ..... A47C 27/20 5/730
6,591,764 B1 * 7/2003 Dean ..... A63F 1/06 108/90
7,955,683 B1 * 6/2011 Ferrell ..... A63B 57/60 15/209.1
D660,068 S * 5/2012 Wang ..... D6/582
D674,225 S * 1/2013 Boyer ..... D6/582
8,510,878 B2 * 8/2013 Wang ..... A47G 27/0237 5/419

(Continued)

*Primary Examiner* — Garrett K Atkinson
(74) *Attorney, Agent, or Firm* — BRADLEY IP, LLC; Sean T. Bradley

(57) ABSTRACT

An elongated, segmented, folding mat with selectable relief segments that may be extended to create relief cutouts that relieve pressure upon a user's sciatica or coccyx when a user is sitting on a folded, multi-layer, elevated portion of the mat comprising a cushion. The cushion height may be raised or lowered by incorporating more or fewer folded sections of the mat into the cushion.

11 Claims, 8 Drawing Sheets

(56) References Cited

U.S. PATENT DOCUMENTS 8,822,012 B2 * 9/2014 Franks ..... A63B 6/00 428/156
9,211,437 B2 * 12/2015 Soba ..... A63B 21/15
D762,399 S * 8/2016 Sorrick ..... D6/582
9,950,208 B2 * 4/2018 Willis ..... A63B 21/4037
2004/0250346 A1 * 12/2004 Vasishth ..... A47G 27/0237 5/420
2007/0233506 A1 * 10/2007 Moore ..... G06Q 50/265 705/325
2007/0275827 A1 * 11/2007 Glaser ..... A63B 21/4037 482/148
2008/0005947 A1 * 1/2008 Barna ..... A63B 69/3661 40/629
2008/0118671 A1 * 5/2008 Bienkiewicz ..... A63B 21/4037 428/12
2008/0124509 A1 * 5/2008 Boise ..... G06F 3/0395 428/45
2008/0178391 A1 * 7/2008 Andrade ..... A47C 1/146 5/705
2010/0072794 A1 * 3/2010 Karovic ..... A47C 7/62 297/188.2
2011/0072581 A1 * 3/2011 Villa ..... A63B 21/4037 5/420
2012/0076981 A1 * 3/2012 Franks ..... A63B 6/00 5/420
2012/0227181 A1 * 9/2012 Cintas ..... A47G 27/0237 112/475.08
2012/0233772 A1 * 9/2012 Wang ..... A63B 21/4037 5/417
2012/0260421 A1 * 10/2012 DeGregorio ..... A47G 27/0237 53/473
2013/0190151 A1 * 7/2013 Scholder ..... A63B 21/4039 482/142
2014/0068858 A1 * 3/2014 Wambeke ..... A47G 9/062 5/420
2014/0335319 A1 * 11/2014 Tsai ..... A63B 21/4037 428/172
2015/0007777 A1 * 1/2015 Nonoguchi ..... A01K 1/0107 119/161
2015/0351524 A1 * 12/2015 Martinez ..... D05B 15/00 112/475.08
2016/0059066 A1 * 3/2016 Willis ..... A63B 21/4037 5/417
2016/0332023 A1 * 11/2016 Taylor ..... B32B 5/18
2017/0080278 A1 * 3/2017 Wiggins ..... A47K 10/02
2017/0095690 A1 * 4/2017 Sharkey ..... A47G 27/0237
2017/0105563 A1 * 4/2017 Dawson ..... D06N 7/0071
2017/0266485 A1 * 9/2017 Willis ..... A63B 71/0036
2017/0291059 A1 * 10/2017 Lin ..... A63B 21/4037
2017/0319896 A1 * 11/2017 Kramer ..... A63B 21/4037
2018/0266021 A1 * 9/2018 Kalati ..... D03D 7/00
2018/0296014 A1 * 10/2018 Carter ..... A63B 71/00
2019/0099654 A1 * 4/2019 Sobalvarro ..... A63B 21/4037
2019/0116904 A1 * 4/2019 Popoca Perez ..... A41F 9/002
2019/0217151 A1 * 7/2019 Wells ..... A63B 71/0054
2019/0350318 A1 * 11/2019 Levine ..... A47K 10/02
2020/0086513 A1 * 3/2020 Ambielli ..... B25F 1/04
2021/0353997 A1 * 11/2021 Gupta ..... A63B 21/4037
2022/0001231 A1 * 1/2022 Fiducia ..... A63B 21/4037

* cited by examiner

FOLDING MAT FOR RELIEVING SCIATIC AND COCCYX PRESSURE WHEN EXERCISING AND MEDITATING

CROSS REFERENCE TO RELATED APPLICATIONS

This application claims the benefit of the prior-filed, provisional patent application, Ser. No. 63/189,202, filed May 16, 2021, incorporated herein by reference.

BACKGROUND OF THE INVENTION

Field of the Invention

The present invention relates to exercise equipment, such as yoga and exercise mats, and more particularly to a folding mat with selectable relief segments that may be moved and positioned to create relief cutouts that relieve pressure from a person's sciatica or coccyx when sitting on a folded, multi-layer, elevated portion of the mat.

Description of the Related Art

Yoga and other exercise and stretching activities are often performed on specialized, purpose-constructed mats to provide a barrier between the person engaged in the activity and a floor surface. Floor surfaces are often less than optimal for direct contact as they may be too hard, slick, dirty, or, in the case of wood, present the possibility of splinters puncturing the skin. Yoga mats (as exercise mats are often referred to whether used specifically for yoga or for other floor exercises, stretching or meditation) provide a barrier to mitigate these negative attributes and also provide a degree of cushioning to make exercises and prolonged positions on a floor more comfortable. In the prior art, yoga mats typically comprise a relatively soft, resilient material such as rubber or neoprene and are dimensioned an appropriate length and width to fully or substantially underlie a person lying upon a floor with legs fully extended and arms at their sides. Yoga mats often comprise an elongated portion of the selected material with a textured surface to increase friction between the mat and the floor and between the user's feet, hands, and other body parts contacting the mat. Often, yoga mats are stored simply by rolling them up into a tubular shape, but some yoga mats are sectioned by spaced-apart creases running transverse to the longitudinal axis of a mat so that a mat may be folded along those creases to attain a folded, rectangular shape having compact dimensions for transport and storage. A key disadvantage of yoga mats in the prior art is that they do not provide a sufficiently cushioned surface to allow a user to sit comfortably for extended periods of time when practicing meditation, or otherwise sitting relatively immobile. In particular, sitting for extended periods of time upon a yoga mat, or any mat of similar flat, thin design, can cause trauma and pain to a user's sciatic nerves and/or coccyx.

What is needed is a mat for use during yoga and other floor exercises, stretching and mediation that readily provides increased cushioning for sitting and, in particular, relieves pressure from a user's sciatic nerves and coccyx.

SUMMARY OF THE INVENTION

One or more embodiments of the present invention may comprise a rubber or neoprene yoga mat having sections defined by spaced-apart creases running transverse to the longitudinal axis of a mat so that a mat may be folded along a selected number of those creases to attain a complete or partial folded, rectangular shape. Transversely spaced apart longitudinal relief cuts located toward one end of the mat, typically traversing the third and fourth sections from the end, define two sciatica relief segments and a coccyx relief segment therebetween, all such segments parallel to one another.

Embodiments of a foldable exercise mat according to the present invention may comprise an elongated, segmented, folding mat with selectable relief segments that are extended to create relief cutouts. The relief cutouts relieve pressure upon a user's sciatica or coccyx when a user is sitting on a folded, multi-layer, elevated portion of the mat forms a cushion. The height of the cushion may be raised or lowered by incorporating more or fewer folded sections of the mat, respectively, into the cushion. The mat typically comprises a relatively soft, resilient material, such as rubber or neoprene and preferably comprises a textured surface. The mat is also typically dimensioned an appropriate length and width to fully or substantially underlie a user lying flat with legs fully extended.

The mat is divided into sections defined by longitudinally spaced-apart creases disposed transverse to the longitudinal axis of the mat. The mat is folded along these creases to attain a folded, rectangular shape for transport, storage or use as a cushion during stretching or exercise. The mat may be partially folded along a select number of creases to attain a folded shape comprising a cushion for a user to rest any of various body parts elevated above the floor surface or above any remaining unfolded portion of the mat.

Embodiments of the mat may comprise sciatic relief segments formed from transversely spaced apart, parallel, longitudinal relief cuts that traverse at least two mat sections, and a coccyx relief segment formed from two transversely spaced apart, parallel, longitudinal relief cuts that also traverse at least two mat sections, typically the same sections as the sciatic relief segment cuts. In certain embodiments, the sciatic relief segments and coccyx relief segment traverse the third and fourth sections from a longitudinal end of the mat.

Other advantages of the invention will become apparent from the following description taken in connection with the accompanying drawings, wherein is set forth by way of illustration and example several embodiments of the present invention.

DETAILED DESCRIPTION

Figure 1:
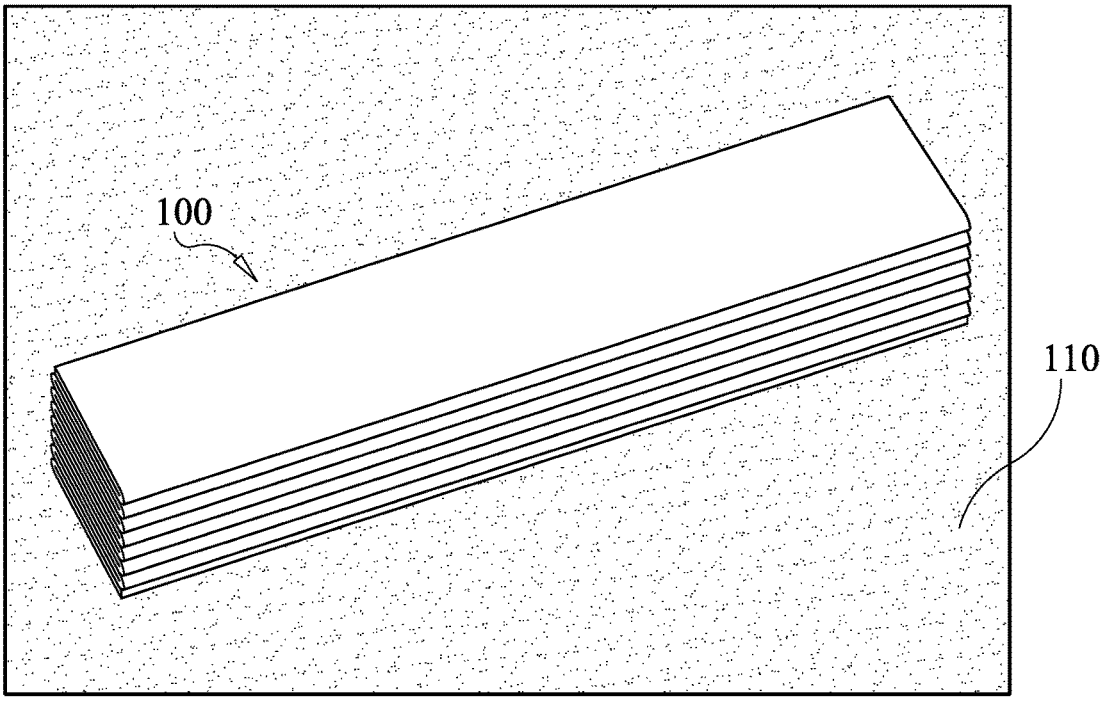
FIG. 1 is a top perspective view of an exercise mat of the present invention in a folded position.

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawings, FIGS. 1-13 illustrate embodiments of the present invention comprising a foldable exercise mat 100, conventionally referred to as a yoga mat. The present invention (hereinafter referred to generally as a "mat," "exercise mat" or "yoga mat" 100) typically comprises a relatively soft, resilient material such as rubber or neoprene and is typically dimensioned an appropriate length and width to fully or substantially underlie a person lying flat upon a floor 110 with legs fully extended and arms at their sides. The mat 100 is therefore elongate and typically includes a textured surface 105 (as shown most clearly in FIG. 5) to increase friction between the mat 100 and the floor and between the user's feet, hands, and other body parts contacting the mat 100. The textured surface 105 of the mat 100 also provides spaces for air to flow along the surface, passing between texturing structures, to provide a cooler and cooling surface and to avoid the user's skin sticking to the surface, particularly when perspiring. The mat 100 is sectioned by spaced-apart creases 115 running transverse to the longitudinal axis of the mat 100 so that the mat 100 may be folded along those creases 115 to attain a folded, rectangular shape having compact dimensions for transport and storage (see FIG. 1), or, if partially folded along a select number of creases 115, to provide a cushion 120 for a user to sit upon, or to lie their head upon, when meditating or resting.

To avoid trauma and pain to a user's sciatic nerves and/or coccyx when sitting for extended periods of time upon the mat 100, transversely spaced apart longitudinal relief cuts 125*a*, 125*b*, 125*c*, 125*d* (collectively 125) are provided to define and form relief segments 130*a*, 130*b*, 130*c* (collectively 130). The relief segments 130 are typically located toward one end of the mat 100, typically traversing the third section 135*a* and fourth section 135*b* (mat sections being referred to collectively by reference numeral 135) from the end, to define two sciatica relief segments 130*a* and 130*c* and a coccyx relief segment 130*b* therebetween, all such segments 130 disposed parallel to one another.

Figure 2:
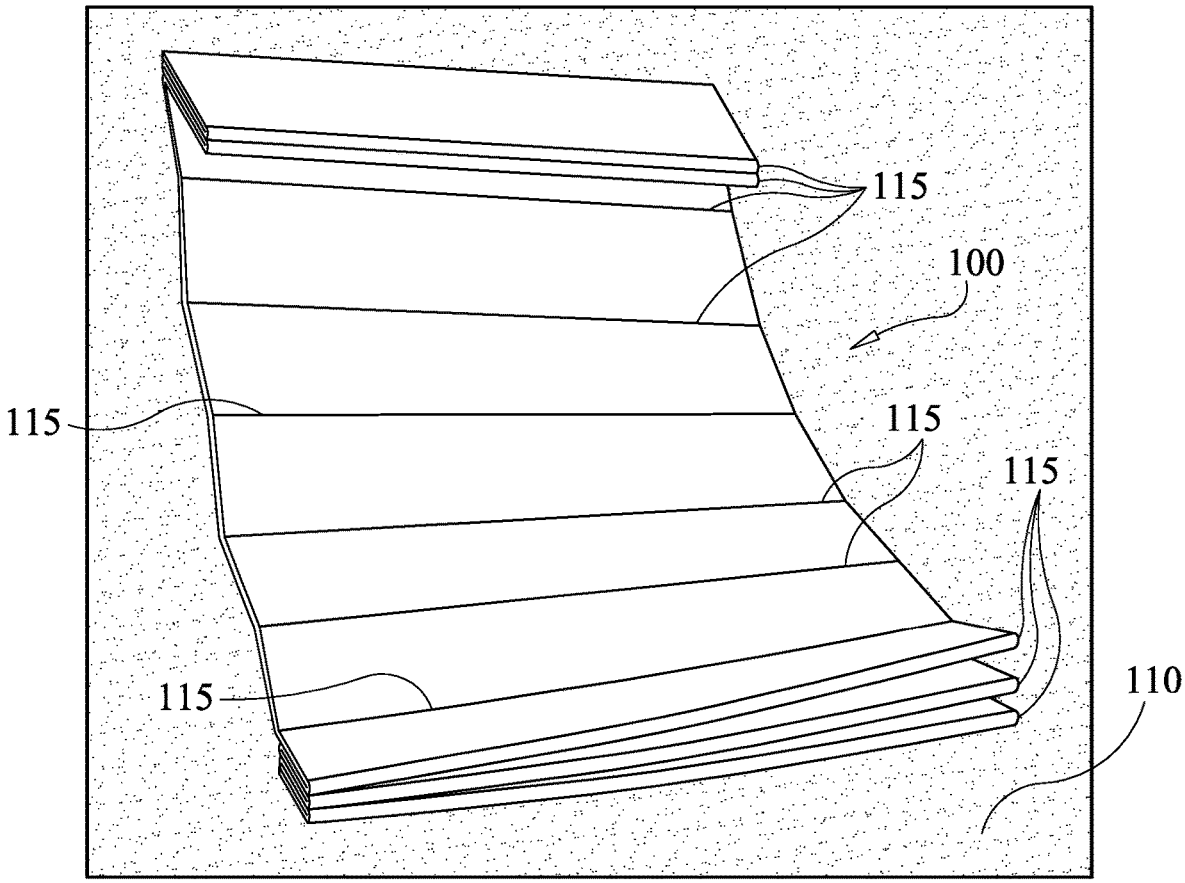
FIG. 2 is a perspective view showing the exercise mat partially unfolded.
Figure 3:
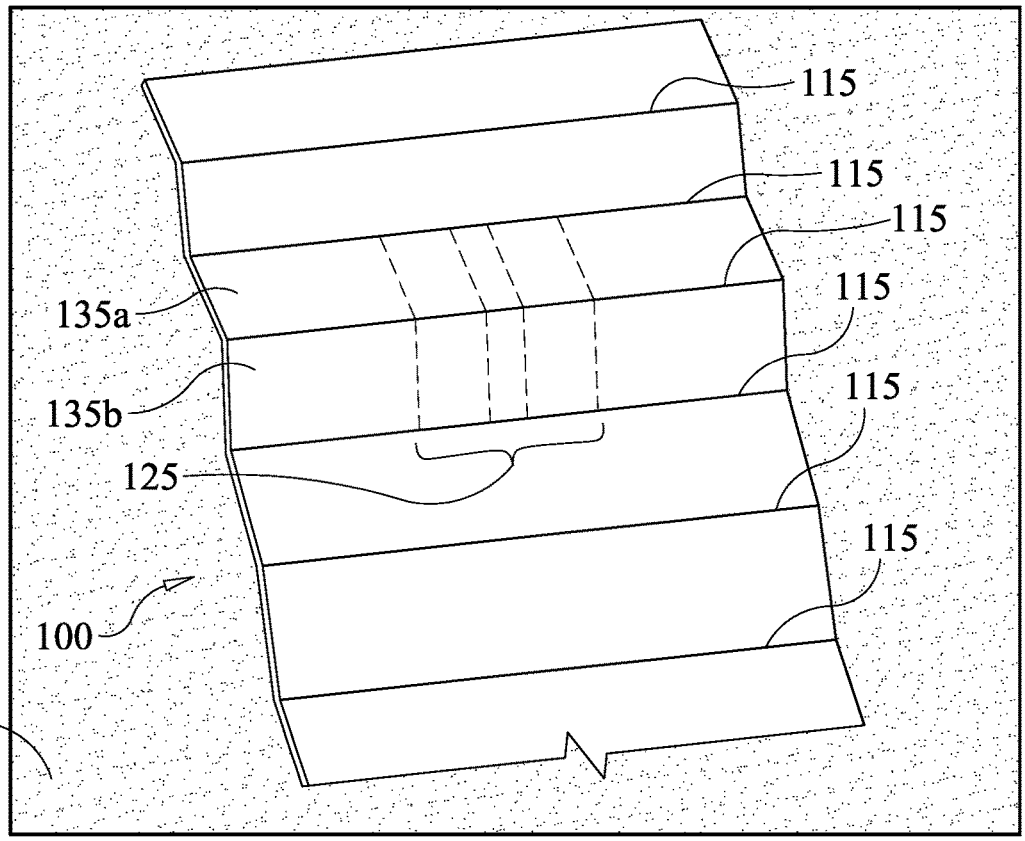
FIG. 3 is a partial top perspective view of the exercise mat fully unfolded.

FIG. 1 is a top perspective view of a mat 100 of the present invention shown in a fully folded disposition. The 100 mat is typically fully folded for transport and storage but may be used in this disposition when a user is exercising or stretching, if convenient. More typically, a mat 100 is used with only selected sections 135 folded to form a cushion 120, while leaving the remaining sections 135 unfolded to provide a shortened mat 100 lying extended and flat upon the floor 110. In particular, see FIGS. 7 through 12, which illustrate a partially unfolded mat 100 and the folded cushion 120 comprising folded sections 135. FIGS. 2 and 3 illustrate a folded mat 100 being partially unfolded.

Figure 4:
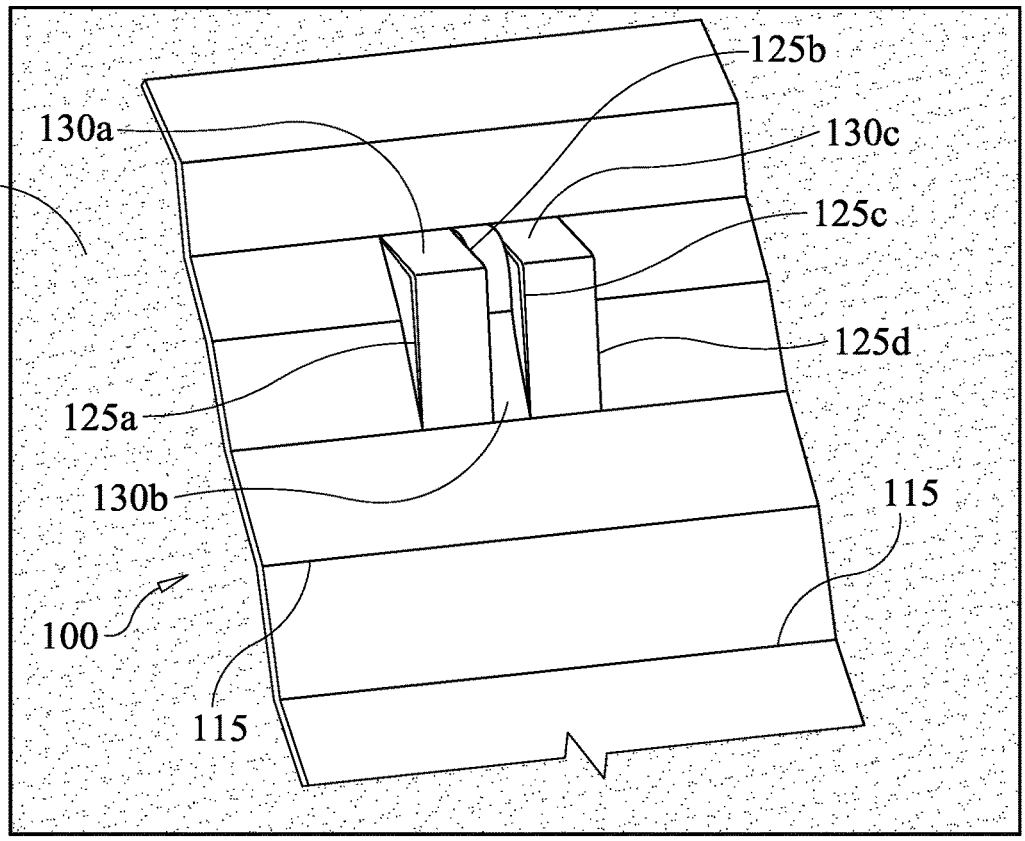
FIG. 4 is a partial top perspective view of the exercise mat showing the relief cuts and relief segments.
Figure 5:
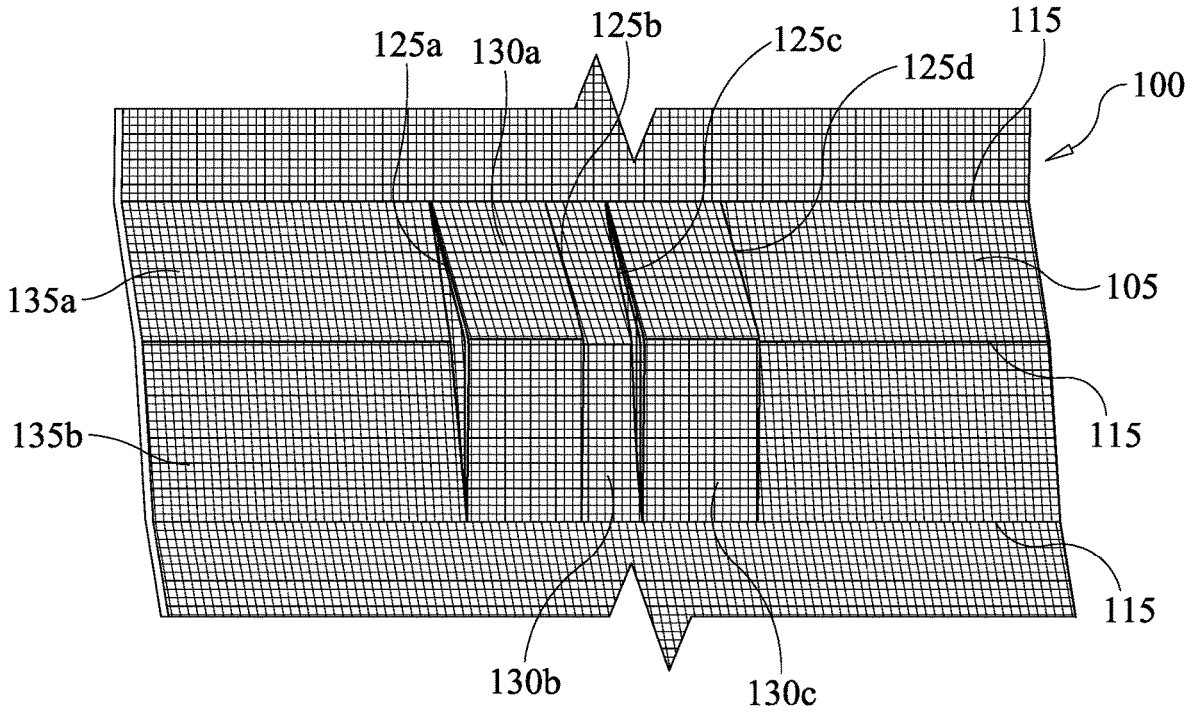
FIG. 5 is an enlarged partial top perspective view of the exercise mat showing the relief cuts, relief segments and textured surface.

FIG. 3 is a partial top perspective view of the mat 100 after it is fully unfolded. FIG. 4 shows the relief cuts 125 and relief segments 130 as the user grasps and pulls the sciatica relief segments 130*a* and 130*c* by reaching through the relief cuts 125. FIG. 5 is an enlarged partial top perspective view of the mat 100 also showing the relief cuts 125 and relief segments 130.

Figure 6:
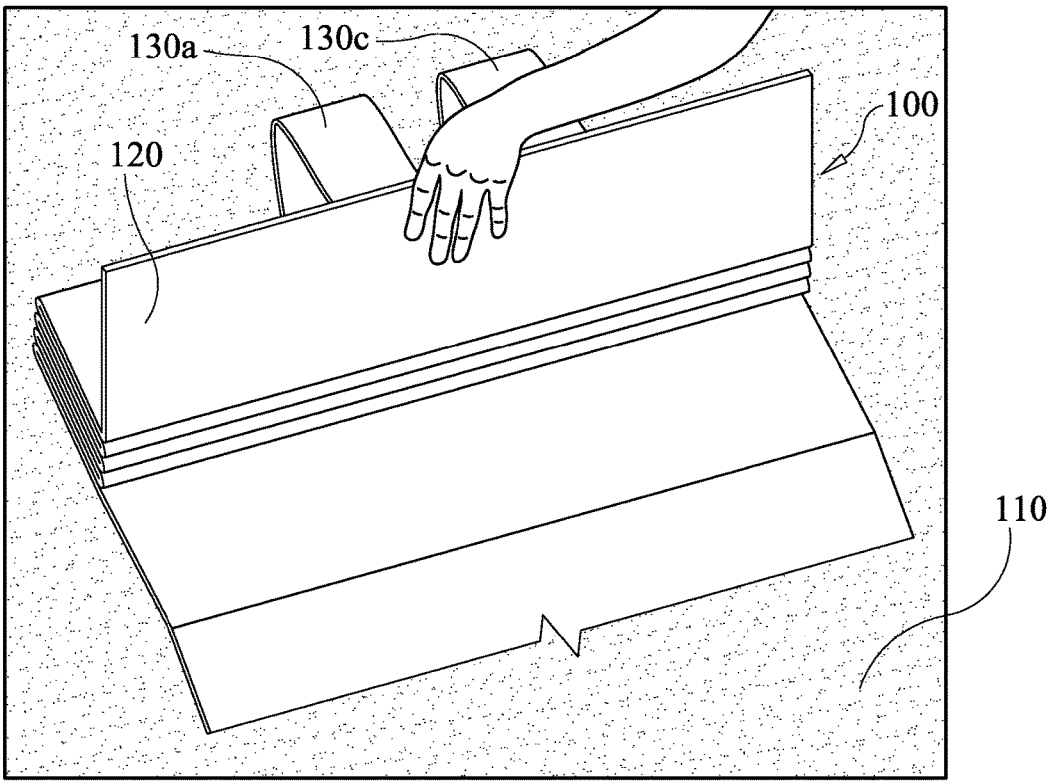
FIG. 6 is a partial top perspective view of the exercise mat showing sciatica relief segments partially extended.
Figure 7:
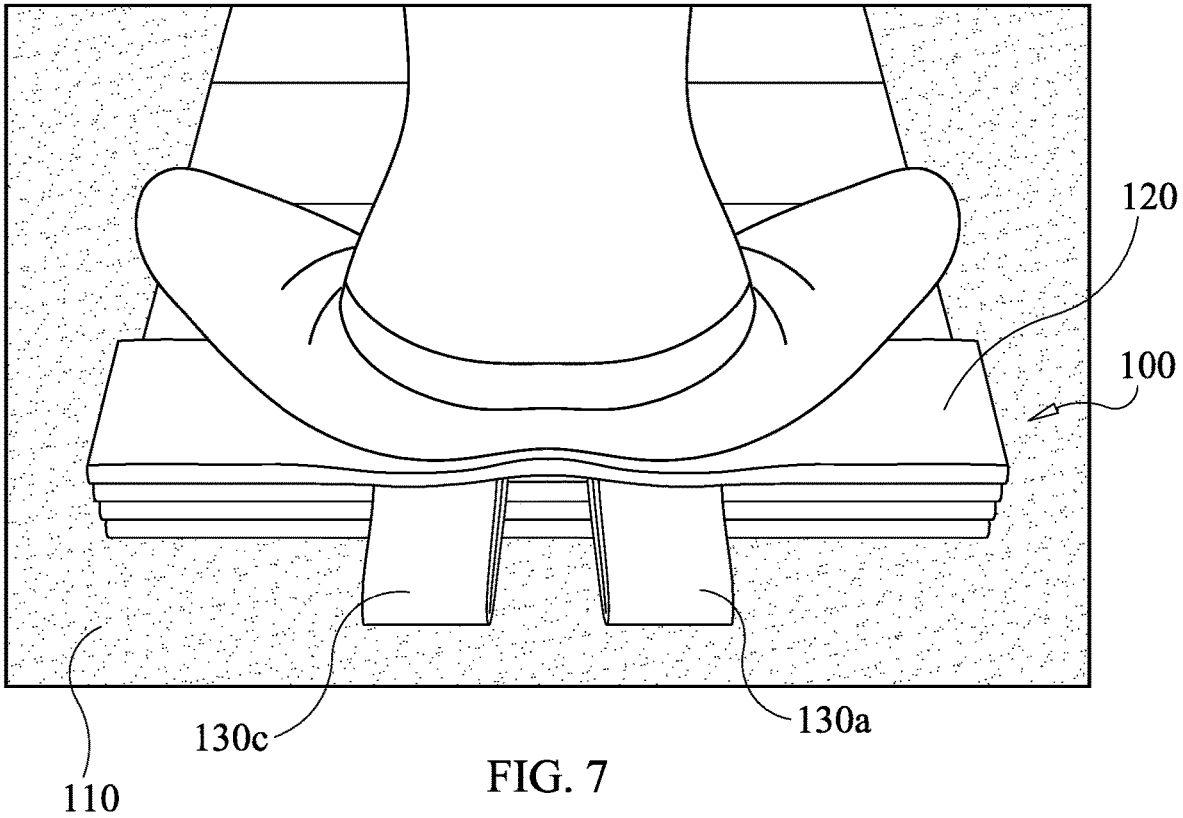
FIG. 7 is a partial top perspective view of the exercise mat showing a user seated upon the cushion with the user's buttocks positioned upon the mat above the underlying sciatica relief cutouts thereby relieving pressure upon the user's *piriformis* muscles which may otherwise excessively impinge upon the sciatic nerves.
Figure 8:
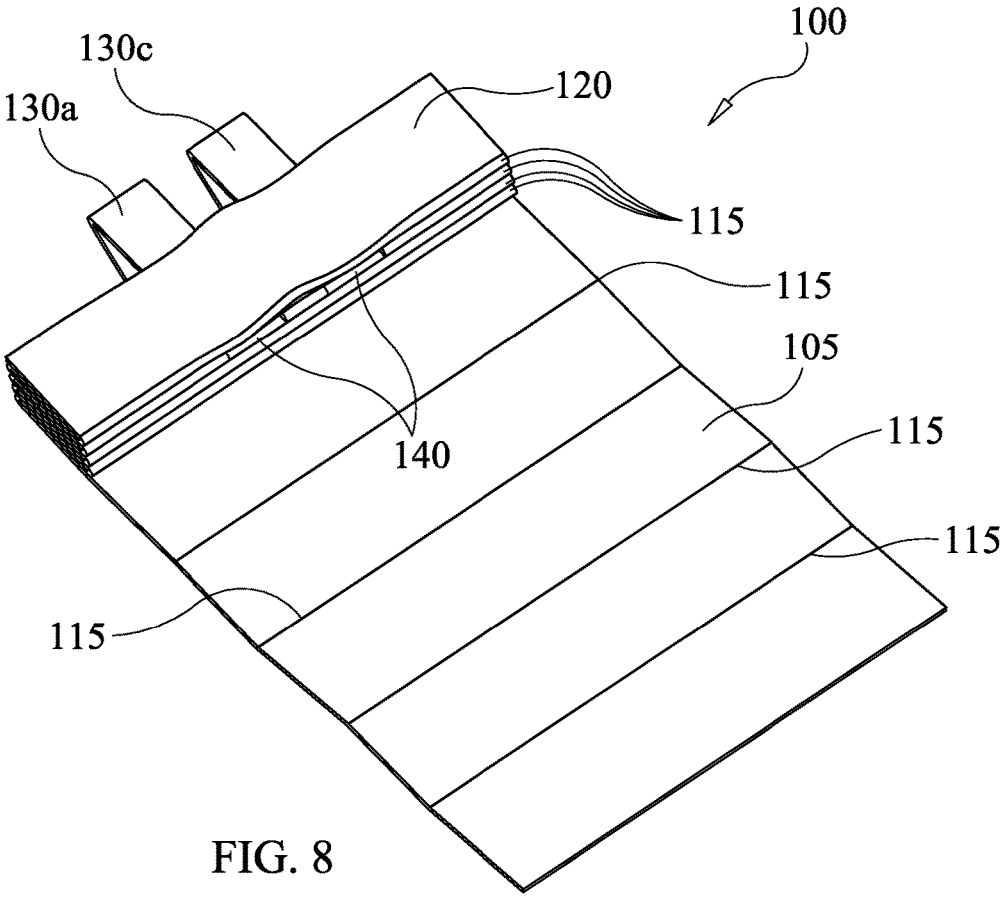
FIG. 8 is a partial top perspective view of the exercise mat showing sciatica relief segments fully extended and also showing the additional downward disposition of the exercise mat cushion that may be attained when downward pressure is applied above the relief cutouts.

FIG. 6 is a partial top perspective view of the mat 100 showing sciatica relief segments 130*a* and 130*c* partially extended by grasping the sciatica relief segments 130*a* and 130*c* as shown in FIG. 4 and pulling them outward. When the sciatica relief segments 130*a* and 130*c* are thus fully extended outward, they leave gaps or sciatica relief cutouts 140 within the structure of the cushion 120 due to the portions of folded sections 135*a* and 135*b* (i.e. segments 130*a* and 130*c*) that no longer lie within the cushion 120. FIG. 8 is a partial top perspective view of the mat 100 showing the sciatica relief segments 130*a* and 130*c* fully extended and also illustrating the additional downward disposition of the cushion 120 that may be attained when downward pressure is applied above the two sciatica relief cutouts 140. FIG. 7 is a partial top perspective view of the mat 100 showing a user seated upon the cushion 120 with the user's buttocks positioned upon the mat 100 above the underlying sciatica relief cutouts 140. The user's weight is thereby shifted away from or diminished from applying pressure upon the user's *piriformis* muscles, which may otherwise excessively impinge upon the sciatic nerves.

Figure 9:
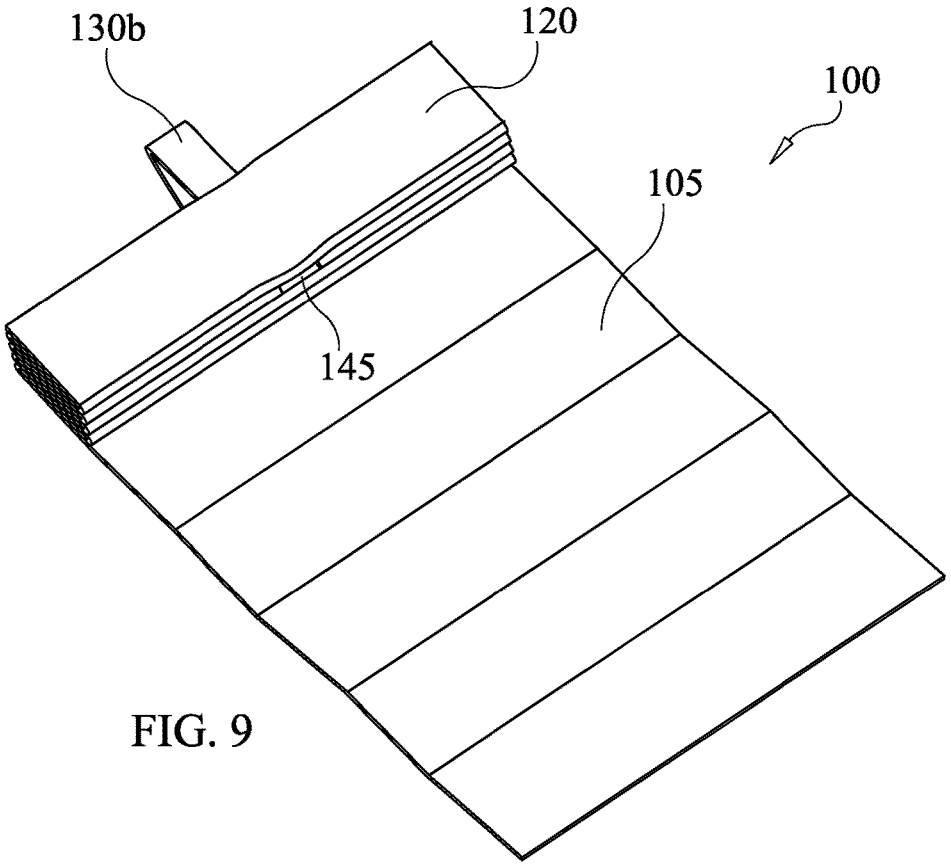
FIG. 9 is a partial top perspective view of the exercise mat showing the coccyx segment fully extended.
Figure 10:
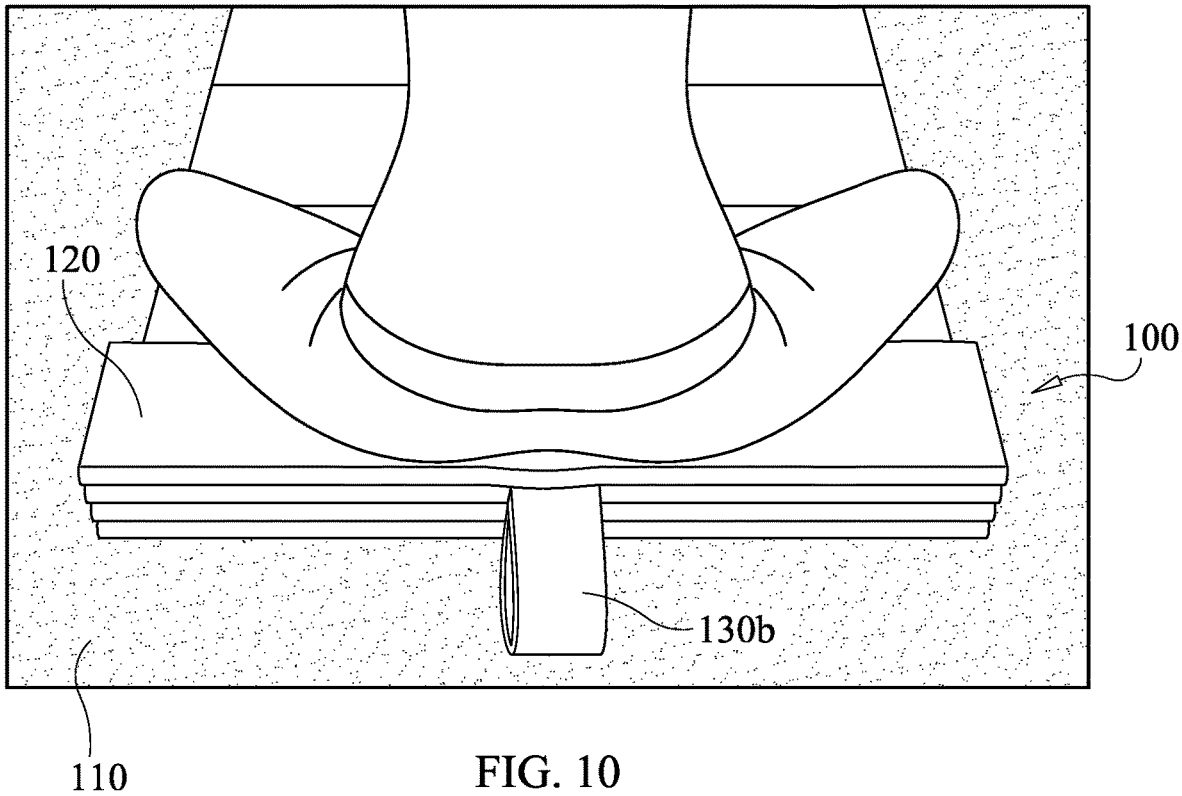
FIG. 10 is a partial top perspective view of the exercise mat showing a user seated upon the cushion with the user's coccyx positioned upon the mat above the underlying coccyx relief cutout thereby relieving pressure upon the user's coccyx.

FIG. 9 is a partial top perspective view of the mat 100 showing the coccyx relief segment 130*b* fully extended thereby creating a coccyx relief cutout 145 in the central portion of the cushion 120. FIG. 10 is a partial top perspective view of the mat 100 showing a user seated upon the cushion 120 with the user's coccyx positioned upon the mat 100 above the underlying coccyx relief cutout 145 thereby relieving pressure upon the user's coccyx.

Figure 11:
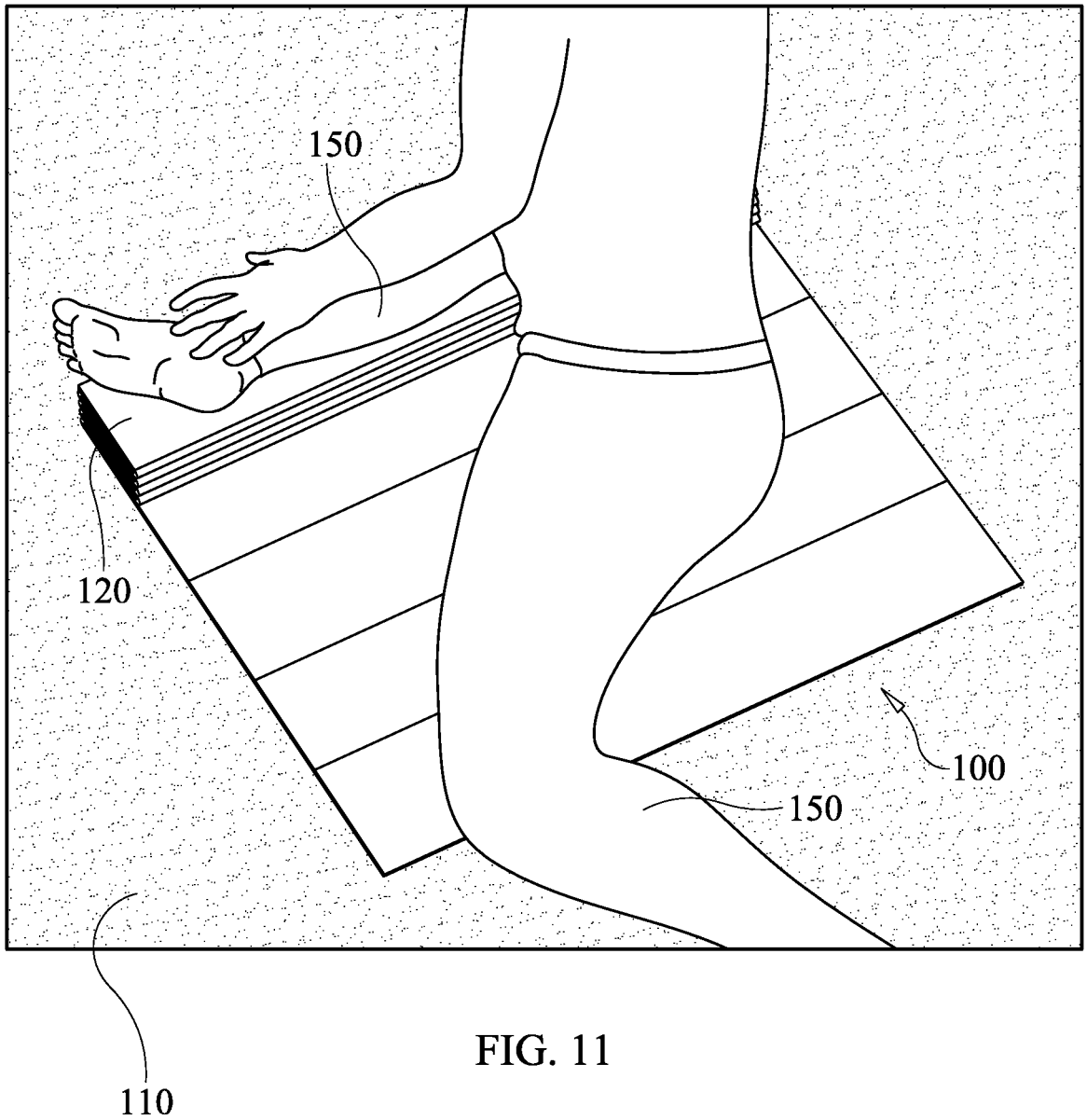
FIG. 11 is a partial top perspective view of the exercise mat showing use of the exercise mat cushion to elevate a limb when performing stretching exercises.

FIG. 11 is a partial top perspective view of the mat 100 showing use of the mat cushion 120 to elevate a user's limb (such as a leg 150, as shown) when performing stretching exercises. The cushion 120 height may be raised or lowered by incorporating more or fewer folded sections 135 of the mat into the cushion 120. Mats 100 may comprise any operable material, but typically comprise rubber or neoprene or equivalent materials. Mats 100 may be fabricated at any length or width considered advantageous or appropriate and may be custom produced to a user's body dimensions.

Figure 12:
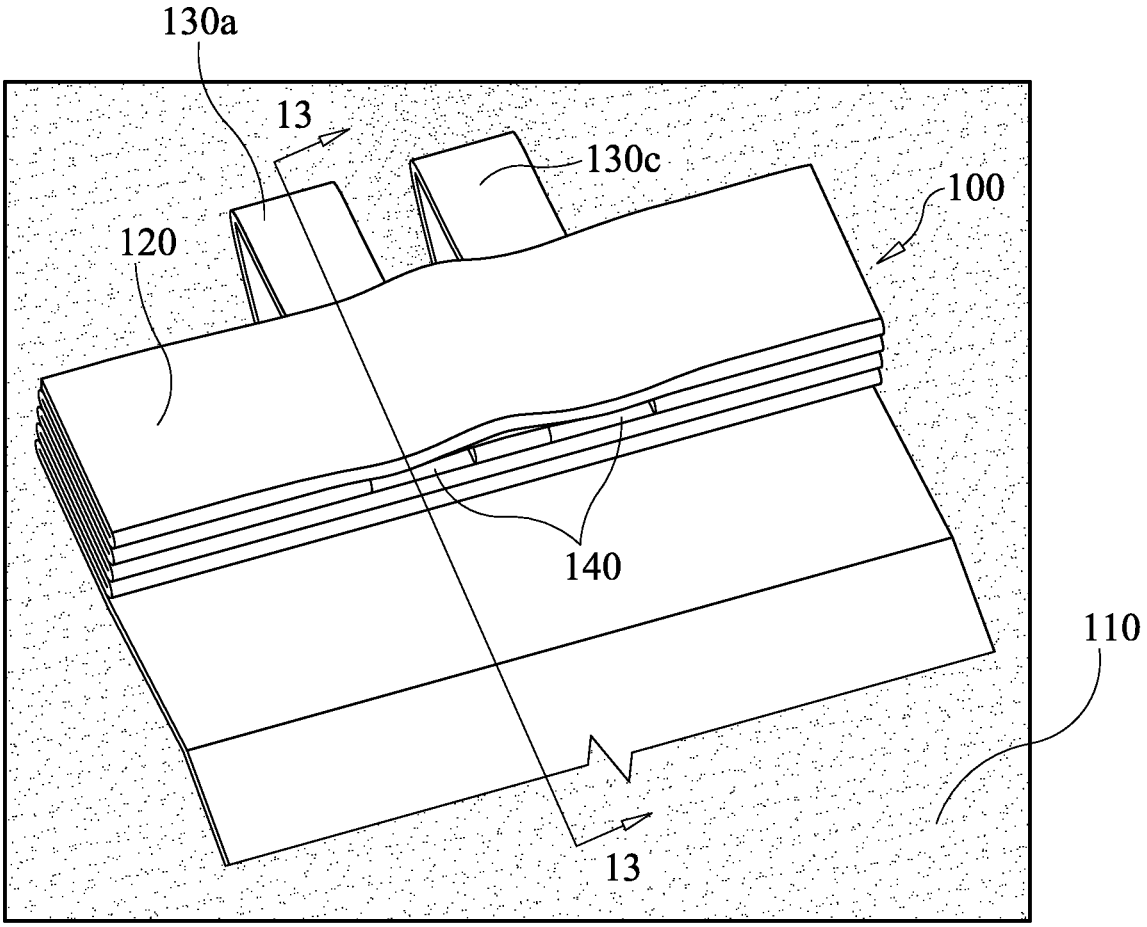
FIG. 12 is a partial top perspective view of the exercise mat showing the sciatica relief segments fully extended.
Figure 13:
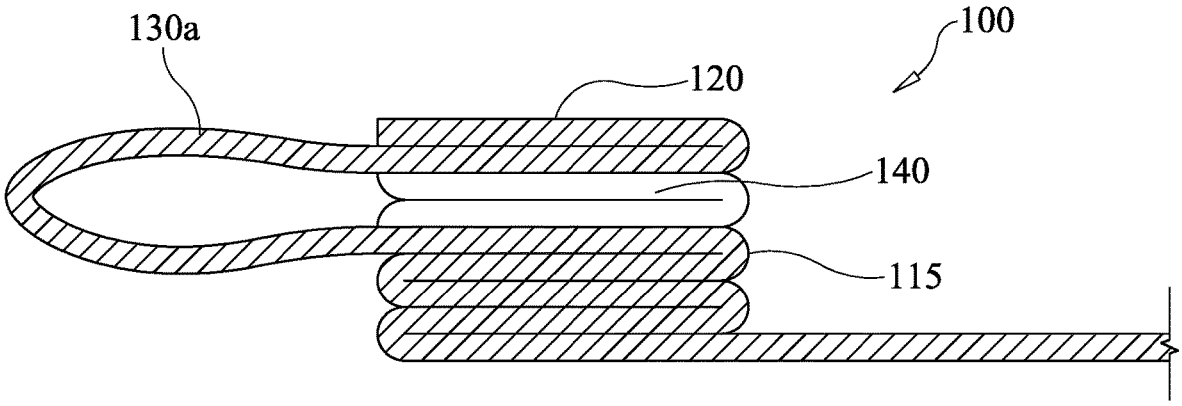
FIG. 13 is a cross sectional view of the exercise mat taken along line 13-13 in FIG. 12.

FIG. 12 is a partial top perspective view of the exercise mat showing the sciatica relief segments fully extended. FIG. 13 is a cross sectional view of the exercise mat taken along line 13-13 in FIG. 12 and showing the void of a sciatica relief cutout 140.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is:

1. A foldable exercise device comprising:

a segmented folding mat comprising: a first end section, a second end section, and a plurality of middle sections;

wherein a plurality of said sections, including at least a partial plurality of said middle sections, of the mat are configured to be folded together to form a stacked cushion;

at least two transversely spaced apart longitudinal relief cuts traversing two adjacent sections of the plurality of middle sections and forming at least one selectable relief segment;

wherein when the mat is folded to form the cushion, the at least one relief segment is configured to be selectably extended outward from the cushion to leave at least one gap or relief cutout within the structure of the cushion, such that when the user is positioned upon the cushion above an underlying gap or relief cutout, the user's weight is shifted to reduce pressure on the coccyx and/or reduce impingement upon the sciatic nerves.

2. The device of claim 1 wherein the height of said stacked cushion may be increased or decreased by incorporating more or fewer folded sections of said mat, respectively, to stack upon one another to form said stacked cushion.

3. The device of claim 1 wherein said mat comprises a relatively soft, resilient material.

4. The device of claim 1 wherein said mat comprises rubber or neoprene.

5. The device of claim 1 wherein said mat comprises a textured surface.

6. The device of claim 1 dimensioned an appropriate length and width to fully or substantially underlie said user lying flat with legs fully extended.

7. The device of claim 1 divided into sections defined by longitudinally spaced-apart creases disposed transverse to the longitudinal axis of said mat.

8. The device of claim 7 folded along said creases to attain a folded, rectangular shape for transport, storage or use as said stacked cushion during stretching or exercise.

9. The device of claim 7 partially folded along a select number of creases to attain a folded shape comprising said stacked cushion for a user to rest any of various body parts elevated above the floor surface or above any remaining unfolded portion of said mat.

10. A foldable exercise device comprising:

a segmented folding mat comprising: a first end section, a second end section, and a plurality of middle sections;

wherein at least the middle sections of the mat are configured to be folded together to form a stacked cushion; and four proximate but transversely spaced apart longitudinal relief cuts traversing two adjacent sections of the plurality of middle sections and forming at least three selectable relief segments, namely, two sciatic relief segments and a coccyx relief segment therebetween; wherein when the mat is folded to form the cushion, the coccyx relief segment is selectably extended outward from the cushion to leave a coccyx relief cutout within the structure of the cushion, such that when the user is positioned upon the cushion above said underlying coccyx relief cutout, the user's weight is shifted to reduce pressure on the coccyx.

11. A foldable exercise device comprising: a segmented folding mat comprising: a first end section, a second end section, and a plurality of middle sections; wherein at least the middle sections of the mat are configured to be folded together to form a stacked cushion; and four proximate but transversely spaced apart longitudinal relief cuts traversing two adjacent sections of the plurality of middle sections and forming at least three selectable relief segments, namely, two sciatic relief segments and a coccyx relief segment therebetween; wherein when the mat is folded to form the cushion, the two sciatic relief segments are selectably extended outward from the cushion to leave two sciatic relief cutouts within the structure of the cushion, such that when the user is positioned upon the cushion above said underlying sciatic relief cutouts, the user's weight is shifted to reduce pressure and impingement upon the sciatic nerves.

* * * * *